US005313742A

United States Patent [19]

Corcoran, Jr. et al.

[11] Patent Number: 5,313,742

[45] Date of Patent: May 24, 1994

[54] HIGHLY RIGID COMPOSITE SHAPED ABRASIVE CUTTING WHEEL

[75] Inventors: Robert F. Corcoran, Jr., Oakham; Srinivasan Ramanath, Holden, both of Mass.

[73] Assignee: Norton Company, Worcester, Mass.

[21] Appl. No.: 640,174

[22] Filed: Jan. 11, 1991

[51] Int. Cl.[5] ..... B24D 5/02

[52] U.S. Cl. ..... 51/206 R; 51/308; 51/206 P; 125/15

[58] Field of Search ..... 51/206 R, 206 NF, 206 P, 51/207, 308, 309, 298; 125/15, 13.01

[56] References Cited

U.S. PATENT DOCUMENTS

| | | | |
|---|---|---|---|
| 2,092,591 | 9/1937 | Sohlstrom | 51/206 |
| 2,475,517 | 7/1949 | Ries | 51/206 NF |
| 2,691,858 | 10/1954 | Andrus | 125/13.01 |
| 2,694,886 | 11/1954 | Allison et al. | 51/206 |
| 3,886,925 | 6/1975 | Regan | 125/15 |
| 4,267,814 | 5/1981 | Benson | 51/206 R |
| 4,341,532 | 7/1982 | Oide | 51/297 |
| 4,547,998 | 10/1985 | Kajiyama | 51/206 R |
| 4,741,743 | 5/1988 | Narayanan et al. | 51/309 |
| 4,929,256 | 5/1990 | Shepherd | 51/295 |

FOREIGN PATENT DOCUMENTS

| | | | |
|---|---|---|---|
| 2802081 | 7/1978 | Fed. Rep. of Germany | 51/207 |

*Primary Examiner*—Robert A. Rose

*Attorney, Agent, or Firm*—Arthur A. Loiselle, Jr.

[57] ABSTRACT

A cutting wheel, especially suitable for dicing silicon wafers and the like, which has a high degree of stiffness as a result of the wheel being a monolith with a thick inner section and thin outer or cutting section.

5 Claims, 1 Drawing Sheet

HIGHLY RIGID COMPOSITE SHAPED ABRASIVE CUTTING WHEEL

FIELD OF THE INVENTION

The invention relates to thin abrasive wheels of the type used for cutting, dicing, scribing, slotting, and squaring of materials utilized by the electronics industry.

BACKGROUND OF THE INVENTION

In many cutting operations which utilize abrasive wheels, both thinness and rigidity or stiffness are essential. Examples of such cutting operations are the dicing, slicing, scribing, slotting, and squaring, which are involved in the processing of silicon wafers and so-call pucks made of an alumina-titanium carbide composite, for the electronics industry in general and the computer industry in particular. As is well known, silicon wafers are processed for integrated circuits while alumina-titanium carbide pucks are utilized to fabricate flying thin film heads for writing (recording) and reading (playing back) information magnetically stored in computers.

The alumina-titanium carbide used to form the pucks is highly pure. The pucks are preferably formed by hot-pressing into discs 2 or 3 inches in diameter and typically about 3/16 of an inch thick. The resulting bodies are extremely hard and therefore very difficult to shape, which necessitates the use of diamond grinding and cutting wheels to further process discs. Because these hot-pressed pucks or discs typically contain unacceptable pits and scratches, a 2 to 3 mil coating of alumina is deposited on the puck and polished to the desired finish.

The circuitry for thin film heads is built on the aforedescribed substrate, by first polishing the surfaces of the so-called puck followed by chemical or metal vapor deposition and photolithography treatments. The materials deposited are e.g. alumina and copper. The pucks or wafers are then overcoated with alumina to protect the newly formed circuits followed by lapping of the alumina coating to precise shape and thickness. Enough of the alumina coating is removed, in predetermined locations on the puck, to expose copper to be used as electrical connectors in the final product.

Most of the remaining steps involve the shaping and separating of the thin film heads which are done preferably with diamond or cubic boron nitride (CBN) abrasive wheels. Usually the ceramic substrate, or puck in the case of thin film heads, is usually round, thus the first step is "squaring off" which involves cutting off of the round edges of the puck so that the ceramic substrate will fit into the process equipment. The squared off puck is slotted along one axis to define scribe lines between each row of heads. The scribe lines penetrate the hard alumina coating and the underlying circuits built into the surface of the puck. To avoid thermal and mechanical stress or damage to the circuit lay, scribing is done at a slow rate with fine grit diamond cutting blades. This operation requires very parallel and accurate cuts in order to prevent chipping which can ultimately cause damage to the thin film heads. For this reason the industry carries out this operation with a gang of thin diamond abrasive contain cut-off wheels or blades i.e. several diamond cut-off blades mechanically joined together with spacers of accurately predetermined thickness located between each cutting blade or wheel.

Once the thin film head circuits have been delineated by scribing, the remainder of the thickness of the substrate is cut through again using a gang saw arrangement of diamond blades or wheels and spacers. The result is several accurately cut bars, each of which contains 5, 6, or more, thin film head circuits depending on the size of the original puck. These bars are then lapped to remove the excess substrate material which remains after the scribing and slicing steps set out above. The bars may or may not be lapped depending on whether or not excess substrate material is remaining.

Once the bar is lapped it is mounted in a cartridge so that the air bearing surfaces, called rails and bleed slots, can be cut into the tops of individual heads. First the rails are cut over the alumina covered head circuits, again using a gang set-up of diamond cutting blades and spacers. Then a wider and shallower plateau is cut between the rail channels. The rails and bleeding slots are cut to form the aerodynamic surfaces that allow the thin film heads to fly, thus they must be cut with extreme precision with respect to the correct depth and width.

The next to the last step in preparing the actual head for a flying thin film head is separating the several heads contained in a bar or row. Again in this step of the process the cutting to separate each individual circuit (head) must be done with unfailing accuracy in order to avoid destroying or damaging the heads. As in some of the preceding steps, this operation is generally carried out using a gang of diamond saw blades or wheels. This next to last operation also requires extreme precision of cut.

The final step is the lapping of each individual head to achieve precise throat height and to bevel or ramp the ends of the rails, the throat being the trough between the rail and bleed slot discussed above For the several aforedescribed steps involving slicing, parting, etc. of pucks with gang saws it is apparent that these cuts must be very accurate in order to avoid damage to the heads being produced. The basic material i.e. alumina-titanium carbide is itself expensive, with the value added as a result of the many steps greatly increasing the cost of a given puck or disc of alumina-titanium carbide. The cuts made by gang saws in processing substrates like alumina-titanium carbide and silicon substrates for thin film heads and integrated circuits respectively, must be made accurately to avoid excess waste of materials and damaged to thin film heads and integrated circuit substrate pieces. In an effort to minimize these costly losses the industry uses gang saw arrangements made up of saw blades that are as stiff as possible and as thin as practical. These two characteristics of the saw blades are obviously contradictory; the thinner the blade the less stiff the blade will be. However, the industry has compromised by using conventionally shaped blades that are a little thicker than desired and not quite as stiff as would be optimum, ganged with precisely sized spacers between the blades. The spacers are smaller in diameter than the blades and are composed of hard rigid materials like steel or bonded tungsten carbide. The wheels are conventionally shaped straight wheels i.e. wheels that are of uniform thickness from the wheel's arbor hole to its periphery.

It is a principal objective of the present invention to overcome the chipping and inaccurate cuts which occur with the presently used straight wheels gauged with spacers.

SUMMARY OF THE INVENTION

The invention is an abrasive wheel of the thin cut-off type which possesses a higher degree of stiffness or rigidity in the annular cutting portion of the wheel than is possessed by a prior art cut-off wheel of equal thickness. The increased rigidity is the result of the wheel being monolithic but having an inner portion or hub which is of greater thickness than the annular or outer cutting portion.

DETAILED DESCRIPTION OF THE INVENTION

Figure 4:
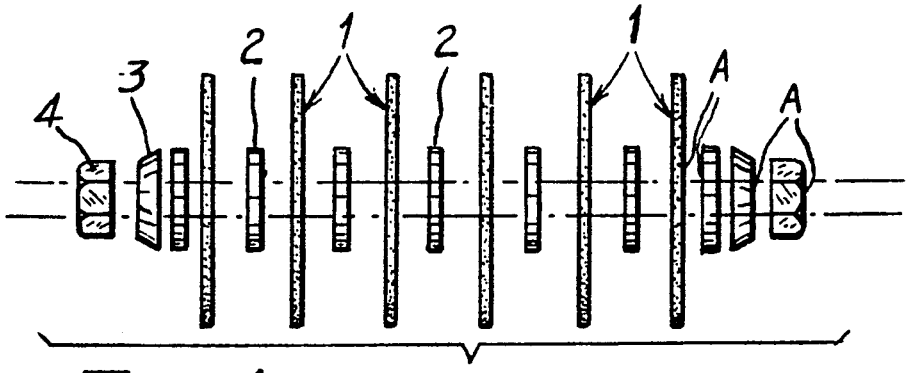
FIG. 4 PRIOR ART
FIG. 4 of the drawing is an exploded view of a gang saw assembly, according to the prior art, which is used for slicing, dicing, separating, and the like, of such materials as silicon and alumina-titanium carbide for the electronics industry.

Referring to the drawing, the prior art is an exploded view of a gang saw arrangement, in current use employed for slicing, dicing, etc., as described above. The arrangement or assembly of saws (cut-off wheels) is made up of thin cutting wheels 1 of uniform radial thickness separated from each other by spacers 2, typically made of aluminum or tungsten carbide, the wheels and spacers are held together and onto an arbor A by virtue of a flange 3 and a nut 4 at each end of the assembled group of wheels 1 and spacers 2. There is, of course, an arbor hole A in each element of the assembly, i.e. in wheel 1, spacer 2, flange 3, and mounting nut 4.

Figure 1:
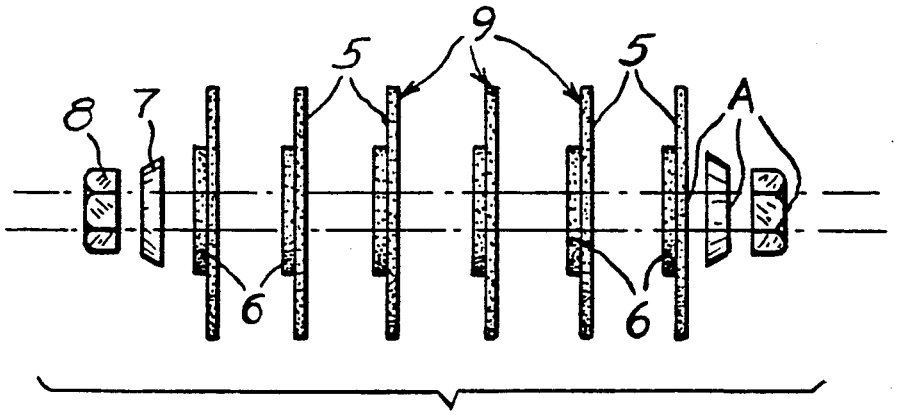
FIG. 1 is an exploded view of a gang saw assembly, according to the present invention which is used in the same manner as the prior art gang saw assembly of FIG. 1.
Figure 2:
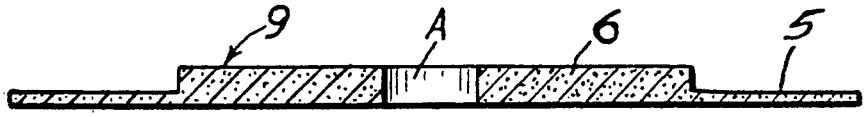
FIG. 2 is an elevated view of a section through the invention wheel as shown in FIG. 2.
Figure 3:
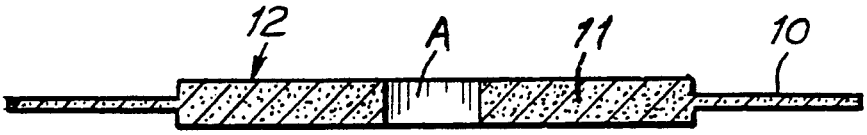
FIG. 3 is an elevated view of a section through another embodiment of the wheel of the present invention.

FIG. 1, by contrast, is an exploded view of an assembly of cutting wheels 9 according to the invention, held together on an arbor with flanges 7 and threaded nuts 8, however, the wheels 9 are monolithic and are not of uniform thickness throughout their radii but rather have a thin outer or annular section 5 which is the cutting portion of the wheel, and a substantially thicker inner section 6 which is not used for cutting. It is the combination of the wheels being monolithic and having a thick inner non-cutting section that makes these wheels an advancement over the prior art, that advancement being a stiffness of 3 to 4 times that of the conventional cutting wheel of the prior art, i.e. a cutting wheel of uniform thickness throughout its radius, when the thickness of such a wheel and the thickness of the annular cutting portion of the invention wheel of FIGS. 1, 2, and 3, are the same. While it is not totally clear why taking a very thin cutting wheel and increasing an inner, annular, non-cutting portion of that wheel increases its stiffness while tightly clamping a wheel of equal and uniform thickness throughout its radius between two spacers does not, that is the result of the cutting wheel of the invention.

Grinding wheels, be they thin cutting wheels according to the present invention, or any of the numerous other types of wheels, are made up basically of abrasive grits and a bond which holds the abrasive grits in the desired shape. The basic structure of the wheels may include porosity varying from essentially zero porosity by volume to as much as 40 or 50% porosity by volume. The preferred volume percent composition of the wheels of the instant invention is 5 to 50% by volume of abrasive, 50 to 95% by volume of bond, and 0 to 25% by volume of pores.

The bond is made up of a binder material per se, and optionally a filler material mixed in with the binder. The binder material may be a liquid, solid or a combination thereof of a polymer or resin such as phenolic resin, epoxy resin, polyester resin, polyurethane, polyimide, polybenzimidazole, aromatic polyamide, and the like. Alternatively the binder material may be any of the metal bonds well known in the industry, used primarily to bond diamond and cubic boron nitride (CBN) abrasive grits. Examples of such metal bonding material are alloys such as Cu-Zn-Ag, Co-WC, Cu-Ni-Zn, Cu-Ni-Sb, Ni-Cu-Mn-Si-Fe, Ni-Cu-Sb-TaC; there are numerous other alloy which have been suggested as binders for grinding wheels and which would fall within the scope of the present invention. Likewise, the invention wheel could utilize any of the numerous vitrified bond compositions well known as bonds for grinding wheels. Hybrids of these three types of bond materials may also be used as bonds, that is, resin containing metal powder, resin impregnated vitrified bonds, and cermets or mixtures of vitrified bond materials and metals.

As mentioned above, the bond, per se, may include any one or more of a variety of materials referred to as fillers. There are basically two types of fillers viz. active fillers and inactive fillers. The former, also referred to as grinding aids, include such materials as molybdenum disilicide, polytetrafluoroethylene, graphite, nickel powder, cryolite, iron disulfide, calcium fluoride, tin, copper, magnesia, potassium sulfate, potassium fluorate, and so on; these materials are in some cases believed to react with the substance being ground or cut, and in other cases the additive functions as a lubricant. The inactive fillers include such inert materials as reinforcing fibers, fine silicon carbide, fine fused alumina, and fine sintered alumina including those sintered alumina produced by the sol gel method of U.S. Pat. No. 4,314,827 and the seeded sol gel sintered abrasives produced by the methods disclosed in U.S. Pat. Nos. 4,623,364 and 4,744,802. Solid filler particles are generally substantially finer than the particle size of the abrasive grits but can be as coarse in some cases. For example, inorganic fillers like silicon carbide, and fillers such as graphite and polytetrafluoroethylene are typically 325 mesh (U.S. Standard Sieve Series); reinforcing fillers such as chopped glass fibers can vary in length of from 5 to 1900 microns. All of the foregoing is well known to those skilled in the art.

The abrasive utilized can be essentially any abrasive such as diamond, CBN, fused alumina, sintered alumina (as described above), silicon carbide or mixtures thereof, the selection of abrasive depending on the material being cut. The abrasive may also include a treatment thereon, i.e. the abrasive grits may be provided with a coating which will vary in its nature, depending on the specific abrasive used. If the abrasive is diamond or CBN then a metal coating on the abrasive, e.g. nickel, has a very substantial effect on the grinding properties of the finished wheel. Fused alumina's grinding quality is enhanced, in certain grinding or cutting applications, if the grain is coated with iron oxide or a silane such as gamma amino propyl triethoxy silane. Sintered sol gel and seeded sol gel alumina abrasive exhibits enhanced grinding properties when they have been supplied with a silica coating, or in some cases, improvement may result if the sintered abrasive is silane treated. The operable abrasive grit size for the wheels of the invention, because it is a cut-off wheel, should be about 80 grit (177 microns or 0.007 mil.) or finer.

The preferred embodiment of the invention is shown as 9 in FIGS. 1 and 2 wherein the wheel 9 is monolithic in nature, i.e. the inner section 6 and the outer section 5 are one piece. Referring to FIGS. 1 and 2, the inner section or hub 6 of the wheel 9 is the same composition as the outer section or cutting portion 5 of the wheel i.e. both sections 5 and 6 of the wheel 9 are made up of essentially the same type and amount of bond abrasive grits and optionally, porosity. Some deviation in the composition of inner section 6 and the outer section is within the scope of the invention so long as the two sections contain the same bond, form a monolith, and the physical properties, e.g. rigidity and thermal expansion characteristics, are about the same.

The improved rigidity of the present wheels over that of prior art wheels is dependent on their physical dimensions, particularly on the relative dimensions of the various parts of sections of wheels. The overall diameter of the wheels should be about 8 inches (20.32 cm) or less, the cutting section 5 in FIGS. 1 and 2 should be about from 0.01 to 0.78 inch (0.25 to 19.81 mm) in radius with a thickness of from about 0.001 to 0.1 inch (0.25 to 2.54 mm), the arbor hole is about 0.125 to 6 inches (3.18 to 152.4 mm), and the diameter of the inner section 6 in FIGS. 1 and 2 is the difference between the overall wheel diameter minus twice the radius of the outer section and a thickness of from about 0.004 to 0.125 (0.10 to 3.18 mm).

The foregoing discussion also applies to the embodiment of the present invention which is shown in FIG. 3.

Wheels according to the present invention may be manufactured by any of the known mixing, molding, and heat treating methods known to those skilled in the art. However, the following examples set out the preferred method.

EXAMPLE I

A conventional abrasive-bond mix was prepared as follows:

1.43 grams of diamond grit having a particle sizing of 4 to 8 microns, and 0.38 grams of 1200 grit silicon carbide were wetted with 0.17 gram of furfural in a mixer. 1.41 grams of phenol-formaldehyde 2-stage resin containing about 9% hexamethylenetetramine, 0.64 gram of 325F graphite powder, and 0.23 gram of chopped glass fibers measuring about 0.016 inch (0.39 mm) in length were thoroughly blended. The furfural wetted diamond and silicon carbide and the phenolic resin-graphite-chopped glass mixture were blended together until a uniform mix resulted. This abrasive bond mix was screened several times to guarantee a high degree of homogeneity. This wheel mix was then transferred to a steel mold made up of a mold band, top and bottom plates and an arbor and appropriately sized shims, with the top plate removed; when assembled, the mold set up provided a cavity measuring 4.125 inches (10.48 cm) in diameter, 0.015 inch (0.38 mm) thick, with an arbor measuring 2.73 inches (6.93 cm) in diameter. The wheel mix was leveled and spread in the mold cavity and the top plate put in position. The mold set up was placed between the platens of a steam heated hot press and the mix contained therein was pressed to size at a temperature of about 160° C. The mold set up and its contents were preheated for about 30 seconds prior to the application of pressure which was then applied at 15 tons for about 30 minutes causing the mold to fully close to the degree predetermined by the shims. The wheel blank measured 4.125 inches (10.48 cm) in diameter, 0.015 inch (0.38 mm) thick, with a 2.73 inch (6.93 cm) arbor hole. The thickness of the wheel was uniform from hole to periphery.

The resulting wheel blank was then finished to size and shape. The overall finished wheel diameter, hole size, and thickness corresponding to the final thickness of the inner section of the wheel were done by O.D. grinding the wheel's periphery to a size of 4 inches (10.16 cm), I.D. grinding the arbor hole to 2.75 inches (6.98 cm) and lapping the sides of the wheel to a wheel thickness of 0.0098 inch (0.25 mm). The outer section or cutting portions 5 in FIGS. 1 and 2 respectively, were then ground into the wheel blank. The final dimensions of the outer or cutting section was 0.150 inch (3.81 mm) in radius, measured from the outer periphery of the inner section 6 in FIGS. 1 and 2, and 0.0055 inch (0.14 mm) in thickness. Thus the dimensions of the finished wheel were 4 inches (10.16 cm) in overall diameter with a 0.150 inch (3.81 mm) long cutting edge which was 0.0055 inch (0.14 mm) thick, an inner section which was 1.1 inches (2.79 cm) measured from the 2.75 inch (6.98 cm) hole to the beginning of the outer cutting section and was 0.0098 inch (0.25 mm) thick.

A prior art wheel, such as that shown as 1 in the exploded view of a gang wheel assembly identified as Prior Art in the drawing, was made in the conventional manner. The resulting wheel was 4 inches (10.16 cm) in diameter, 0.0055 inch (0.14 mm) thick, with a 2.75 inch (6.98 cm) hole. This wheel was identical in all respects to the invention wheel, the making of which is described above except that this prior art wheel was of uniform thickness, viz. 0.0055 inch (0.14 mm) from the arbor hole to the periphery, whereas the invention wheel had a cutting edge of 0.0055 inch (0.14 mm) as did the prior art wheel but had an inner section which was 0.0098 inch (0.25 mm) thick, almost twice the thickness of its outer or cutting section and almost twice the thickness of the prior art wheel.

EXAMPLE II

The stiffness of the peripheral i.e. cutting portion of both the prior art wheel and the wheel according to the invention was measured. For this rigidity test prior art and wheels according to the invention were made in the identical manner. described above except that the diamond abrasive was 20 through 30 grit, the diameter of all wheels was 4.5 inches (11.43 cm), the thickness of the outer section of the invention wheel was 0.013 inch (0.33 mm) which was equal to the thickness of the prior art wheel throughout its radius, and the thickness of the inner section of the invention wheel was 0.028 inch (0.71 mm).

The wheels so prepared were tested for stiffness by mounting each wheel between two steel flanges which measured about 4.35 inches (11.05 cm) which was about 0.20 inch (5.08 mm) less than the diameter of the inner section of the invention wheel. This assembly was mounted in an Instron machine. Force was applied to the side of each wheel about 0.010 inch (0.25 mm) in from the periphery using a rod 0.090 inch (2.29 mm) in diameter under the following conditions:

(a) Instron compression using 25,000 pound load cell (b) Chart speed 2 inches (5.08 cm) per minute (c) Downfeed of 0.02 inch (0.51 mm) per minute The invention wheels were tested by applying the force toward the outer edge of the wheel with the stepped side of the wheel facing upwardly toward the force imparting rod (surface x), and with the flush side of the wheel facing upwardly toward the force imparting rod (surface y). The results were as follows:

| Wheel | Force per Unit Length of Deflection | |
|---|---|---|
| Prior Art | 106.25 lbs/in | 1897.63 kg/m |
| | 135.70 " | 2423.60 " |
| | 160.00 " | 2857.60 " |
| Ave. | 133.98 " | 2392.94 " |
| Invention Wheel (x) | 311.11 lbs/in | 5556.42 kg/m |
| | 387.50 " | 6920.75 " |
| | 355.55 " | 6350.12 " |
| Ave. | 351.38 " | 6275.76 " |
| Invention Wheel (y) | 537.50 lbs/in | 9599.75 kg/m |
| | 411.10 " | 7342.25 " |
| Ave. | 474.30 " | 8471.00 " |

As is evident from the foregoing test data, the wheels of the present invention are about 2.5 to 3.5 times more rigid than the prior art wheels for the same thickness of cutting portion. Not only are the invention wheels three times stiffer than correspondingly thick prior art wheels with the attendant advantage, but the present wheels eliminates the need for costly spacers which must be used with prior art wheels. The invention wheels should be at least twice as stiff as a prior art wheel of the same thickness.

While the foregoing examples are directed to bonded cut-off wheels this should not be construed as a limitation, for example, a wheel blank or core shaped like 9 in FIGS. 1 and 2 could be coated on its peripheral edge with an electrodeposited or electroless deposited single layer of abrasive.

What is claimed is:

1. A monolithic abrasive cutting wheel comprising an inner section and an outer section, said inner section being substantially thicker than said outer section; at least said outer section comprising abrasive grain and a bond therefor, and a thickness of from about 0.001 inch to about 0.098 inch; wherein said abrasive is selected from the group consisting of diamond, cubic boron nitride, silicon carbide, fused aluminum oxide, sintered alumina, filament shaped sintered aluminum oxide, silicon nitride, boron carbide, and mixtures thereof; and wherein said abrasive is coated with a silane.

2. A monolithic abrasive cutting wheel comprising an inner section and an outer section, said inner section being substantially thicker than said outer section; at least said outer section comprising abrasive grain and a bond therefor, and a thickness of from about 0.001 inch to about 0.098 inch; wherein the abrasive is fused sintered alumina which is coated with silica.

3. A monolithic abrasive cutting wheel comprising an inner section and an outer section, said inner section being substantially thicker than said outer section; at least said outer section comprising abrasive grain and a bond therefor, and a thickness of from about 0.001 inch to about 0.098 inch; wherein the inner section has a diameter of from about 1.9 inches to about 4.5 inches and a thickness of from about 0.006 inch to about 0.125 inch; said wheel having an overall diameter of from about 2.2 inches to about 4.6 inches; said bond throughout said wheel is a resin; said outer section further comprising a filler which is a mixture of fine silicon carbide, graphite, and chopped glass fibers; said abrasive is diamond; and the stiffness of said outer section is from about 200 pounds per inch to about 500 pounds per inch.

4. A monolithic abrasive cutting wheel comprising an inner section and an outer section, said inner section being substantially thicker than said outer section; at least said outer section comprising abrasive grain and a bond therefor, and a thickness of from about 0.001 inch to about 0.098 inch; wherein said abrasive is selected from the group consisting of diamond, cubic boron nitride, silicon carbide, fused aluminum oxide, sintered alumina, filament shaped sintered aluminum oxide, silicon nitride, boron carbide, and mixtures thereof; wherein said bond further comprises a filler and wherein said filler is coated with a silane.

5. A monolithic abrasive cutting wheel comprising an inner section and an outer section, said inner section being substantially thicker than said outer section; at least said outer section comprising abrasive grain and a bond therefor, and a thickness of from about 0.001 inch to about 0.098 inch, wherein said abrasive is selected from the group consisting of diamond, cubic boron nitride, silicon carbide, fused aluminum oxide, sintered alumina, filament shaped sintered aluminum oxide, silicon nitride, boron carbide, and mixtures thereof, wherein said bond further comprises a filler and wherein the abrasive and the filler are each coated with a silane.

* * * * *